US010801532B2

(12) United States Patent
Ogawa et al.

(10) Patent No.: US 10,801,532 B2
(45) Date of Patent: Oct. 13, 2020

(54) WORK MACHINE

(71) Applicant: Hitachi Construction Machinery Co., Ltd., Taito-ku, Tokyo (JP)

(72) Inventors: Yuichi Ogawa, Tsuchiura (JP); Seiji Hijikata, Tsukuba (JP); Masatoshi Hoshino, Tsuchiura (JP); Kiwamu Takahashi, Moriyama (JP); Kouji Ishikawa, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/327,928

(22) PCT Filed: Mar. 29, 2017

(86) PCT No.: PCT/JP2017/013074
§ 371 (c)(1),
(2) Date: Feb. 25, 2019

(87) PCT Pub. No.: WO2018/179183
PCT Pub. Date: Oct. 4, 2018

(65) Prior Publication Data
US 2019/0186106 A1 Jun. 20, 2019

(51) Int. Cl.
*F15B 21/14* (2006.01)
*E02F 9/22* (2006.01)
(Continued)

(52) U.S. Cl.
CPC ..... *F15B 21/14* (2013.01); *E02F 3/32* (2013.01); *E02F 3/425* (2013.01); *E02F 3/435* (2013.01);
(Continued)

(58) Field of Classification Search
CPC ..... F15B 1/024; F15B 1/0275; F15B 1/033; F15B 21/14; E02F 9/2217; E02F 9/2246; E02F 9/2285
See application file for complete search history.

(56) References Cited

U.S. PATENT DOCUMENTS 6,167,701 B1 * 1/2001 Hatcher ..... E02F 9/2207 60/416
7,634,911 B2 * 12/2009 Brinkman ..... E02F 9/2075 60/414
(Continued)

FOREIGN PATENT DOCUMENTS

JP 2009-275771 A 11/2009
JP 4831679 B2 12/2011
JP 2012-13203 A 1/2012

OTHER PUBLICATIONS

International Preliminary Report on Patentability (PCT/IB/338 & PCT/IB/373) issued in PCT Application No. PCT/JP2017/013074 dated Oct. 10, 2019, including English translation of document C2 (Japanese-language Written Opinion (PCT/ISA/237) previously filed on Feb. 25, 2019) (right (8) pages).
(Continued)

*Primary Examiner* — Michael Leslie
(74) *Attorney, Agent, or Firm* — Crowell & Moring LLP

(57) ABSTRACT

A work machine including: a hydraulic cylinder 20 configured to drive a work implement 3; a control valve 22 configured to connect a delivery line of a hydraulic pump 21 switchingly to a bottom fluid chamber and a rod fluid chamber of the hydraulic cylinder 20 and a tank; a pilot pump 23 configured to output a pilot pressure to drive the control valve 22; an engine 24 configured to drive the hydraulic pump 21 and the pilot pump 23; and an accumulator 26 configured to accumulate a return hydraulic fluid from the hydraulic cylinder 20 is provided with: a bypass
(Continued)

line 41 configured to connect the bottom fluid chamber of the hydraulic cylinder 20 and a delivery line 21*a* of the hydraulic pump 21 by bypassing the control valve 22 and be provided with the accumulator 26 thereon; a pressure-accumulation control valve 27 provided between the bottom fluid chamber of the hydraulic cylinder 20 and the accumulator 26; a release control valve 28 provided between the accumulator 26 and the delivery line 21*a*; and a hydraulic system controller 30 configured to open the release control valve 28 if an engine revolution speed N becomes lower than a set value Ns.

8 Claims, 10 Drawing Sheets

(51) Int. Cl.

| | |
|---|---|
| ***E02F 9/20*** | (2006.01) |
| ***E02F 3/42*** | (2006.01) |
| ***E02F 3/43*** | (2006.01) |
| ***F15B 11/10*** | (2006.01) |
| ***F15B 1/02*** | (2006.01) |
| ***E02F 3/32*** | (2006.01) |
| ***F15B 21/047*** | (2019.01) |
| ***F15B 21/044*** | (2019.01) |
| ***F15B 21/08*** | (2006.01) |
| *F15B 1/033* | (2006.01) |

(52) U.S. Cl.

CPC ..... *E02F 9/2004* (2013.01); *E02F 9/22* (2013.01); *E02F 9/2217* (2013.01); *E02F 9/2225* (2013.01); *E02F 9/2246* (2013.01); *E02F 9/2267* (2013.01); *E02F 9/2271* (2013.01); *E02F 9/2285* (2013.01); *E02F 9/2292* (2013.01); *F15B 1/024* (2013.01); *F15B 11/10* (2013.01); *F15B 21/044* (2013.01); *F15B 21/047* (2013.01); *F15B 21/087* (2013.01); *E02F 9/2296* (2013.01); *F15B 1/033* (2013.01); *F15B 2201/51* (2013.01); *F15B 2211/20523* (2013.01); *F15B 2211/20546* (2013.01); *F15B 2211/20576* (2013.01); *F15B 2211/212* (2013.01); *F15B 2211/275* (2013.01); *F15B 2211/3116* (2013.01); *F15B 2211/329* (2013.01); *F15B 2211/41527* (2013.01); *F15B 2211/575* (2013.01); *F15B 2211/625* (2013.01); *F15B 2211/633* (2013.01); *F15B 2211/635* (2013.01); *F15B 2211/6306* (2013.01); *F15B 2211/6309* (2013.01); *F15B 2211/6316* (2013.01); *F15B 2211/6355* (2013.01); *F15B 2211/7053* (2013.01); *F15B 2211/85* (2013.01); *F15B 2211/853* (2013.01); *F15B 2211/857* (2013.01)

(56) References Cited

U.S. PATENT DOCUMENTS

| | | | | |
|---|---|---|---|---|
| 9,932,993 | B2 * | 4/2018 | Zhang | F15B 11/024 |
| 10,280,948 | B2 * | 5/2019 | Vigholm | E02F 3/431 |
| 10,352,338 | B2 * | 7/2019 | Hahn | F15B 11/10 |
| 10,400,802 | B2 * | 9/2019 | Sugano | F15B 1/024 |
| 10,526,768 | B2 * | 1/2020 | Hijikata | F15B 11/16 |
| 2017/0363112 | A1 * | 12/2017 | Hahn | E02F 9/2296 |
| 2017/0363122 | A1 * | 12/2017 | Hahn | F15B 1/024 |

OTHER PUBLICATIONS

International Search Report (PCT/ISA/210) issued in PCT Application No. PCT/JP2017/013074 dated Jun. 6, 2017 with English translation (two (2) pages).

Japanese-language Written Opinion (PCT/ISA/237) issued in PCT Application No. PCT/JP2017/013074 dated Jun. 6, 2017 (four (4) pages).

* cited by examiner

WORK MACHINE

TECHNICAL FIELD

The present invention relates to a work machine such as a hydraulic excavator, and in particular relates to a work machine including an accumulator that collects and regenerates potential energy.

BACKGROUND ART

A work machine such as a hydraulic excavator is constituted by a boom, an arm, a bucket and the like, and has a work implement that pivots up and down by a hydraulic fluid being supplied from a hydraulic pump to a hydraulic actuator. Consumption of prime mover power can be reduced if the potential energy is collected at the time when the work implement moves down due to its own weight, and the collected potential energy is reutilized. In view of this, there are work machines that collect the potential energy by accumulating a return hydraulic fluid from hydraulic actuators in accumulators, release the accumulated hydraulic fluid and supply it to the hydraulic actuators to thereby regenerate the potential energy. However, in this type of work machine, if the hydraulic fluid remains accumulated in an accumulator and left there for a long time, gas in a gas chamber of the accumulator dissolves into the hydraulic fluid, and there is a fear that the pressure-accumulation capability of the accumulator might lower unless re-filling of gas is performed. A hydraulic controller for preventing this has been disclosed, in which a pressure-accumulation fluid in an accumulator is released automatically also if a prime mover of a work machine is stopped by a key-off operation, in addition to that the pressure-accumulation fluid can be released by a manual operation (see Patent Document 1 etc.).

PRIOR ART DOCUMENT

Patent Document

Patent Document 1: Japanese Patent No. 4831679

SUMMARY OF THE INVENTION

Problem to be Solved by the Invention

In the hydraulic controller of Patent Document 1, a process of releasing a pressure-accumulation fluid in the accumulator is executed when triggered by performance of a manual operation or a key-off operation. Because of this, the pressure-accumulation fluid is not released if the prime mover stops not as a result of the key-off operation, as in the case of engine stalling or the like. If an operator gets off the work machine without reactivating the prime mover, there is a fear that the pressure-accumulation fluid might remain accumulated in the accumulator unless the operator is aware that the hydraulic fluid in the accumulator has not been released and releases the pressure-accumulation fluid in the accumulator by a manual operation.

An object of the present invention is to provide a work machine that can suppress dissolution of gas into the pressure-accumulation fluid in an accumulator, following automatic release of the pressure-accumulation fluid when a prime mover stops or in other cases.

Means for Solving the Problem

In order to achieve the above-mentioned object, the present invention provides a work machine including: a work machine main body; a work implement attached to the work machine main body; a hydraulic cylinder configured to drive the work implement; a hydraulic pump configured to deliver a hydraulic fluid to drive the hydraulic cylinder; a control valve configured to switch a connection destination of a delivery line of the hydraulic pump, to connect to at least one of a bottom fluid chamber and a rod fluid chamber of the hydraulic cylinder and a tank; a pilot pump configured to output a pilot pressure to drive the control valve; a prime mover configured to drive the hydraulic pump and the pilot pump; an operation device configured to generate an operation signal to reduce the pilot pressure output from the pilot pump according to an operation to drive the control valve; and an accumulator configured to accumulate a return hydraulic fluid from the hydraulic cylinder, the work machine including: a bypass line configured to connect the bottom fluid chamber of the hydraulic cylinder and the delivery line of the hydraulic pump by bypassing the control valve and be provided with the accumulator thereon; a pressure-accumulation control valve configured to be provided in the bypass line and between the bottom fluid chamber of the hydraulic cylinder and the accumulator; a release control valve provided in the bypass line and between the accumulator and the delivery line of the hydraulic pump; and a controller configured to perform control of opening the release control valve if a revolution speed of the prime mover becomes lower than a set value.

Advantages of the Invention

According to the present invention, it is possible to suppress dissolution of gas into a pressure-accumulation fluid in an accumulator, following automatic release of the pressure-accumulation fluid when a prime mover stops or in other cases.

MODES FOR CARRYING OUT THE INVENTION

Hereinafter, embodiments of the present invention are explained using the drawings.

First Embodiment

Work Machine

Figure 1:
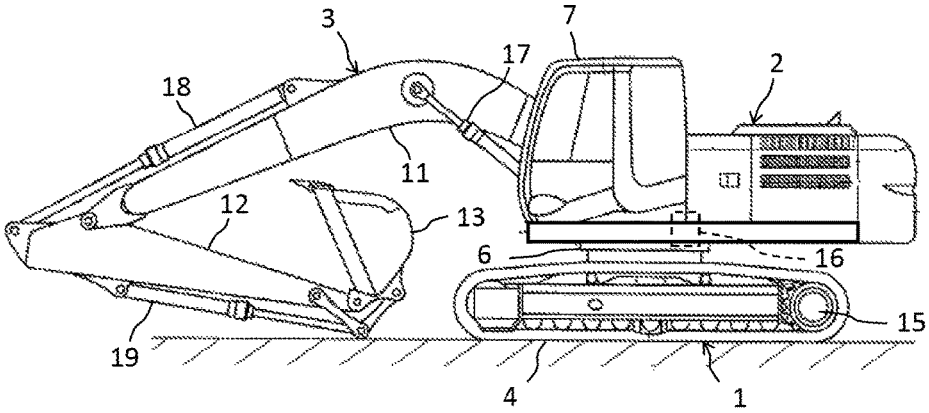
FIG. 1 is a side view illustrating an appearance configuration of a hydraulic excavator which is a representative example of a work machine according to the present invention.

FIG. 1 is a side view illustrating an appearance configuration of a hydraulic excavator which is a representative example of a work machine according to the present invention. In the following explanation, unless noted otherwise, a front side of an operator's seat is defined as a front side (a leftward direction in the figure) of a machine body. Note that exemplification of the hydraulic excavator does not limit application subjects of the present invention, but the present invention can be applied also to other types of work machine such as cranes as long as such work machines have work implements that pivot up and down.

The hydraulic excavator illustrated in FIG. 1 includes: a work machine main body having a track structure 1 and a swing body 2; and a work implement (front work implement) 3. The track structure 1 is a lower structure of the work machine, and is of a crawler type having left and right crawlers 4. Note that in the case of a stationary work machine, it includes a post or the like fixed to the ground as the lower structure in place of a track structure in some cases. The swing body 2 is provided swingably to an upper section of the track structure 1 via a slewing ring 6, and includes a cabin 7 at its front left section. Note that it is not limited to a structure in which the lower structure swings relative to an upper structure like the track structure 1 and the swing body 2, but the upper structure does not swing relative to the lower structure in some cases. In the cabin 7, an operator's seat (not illustrated) on which an operator sits, and an operation device (operation device 25 etc. in FIG. 2) that an operator operates are arranged. The work implement 3 includes a boom 11 attached pivotably to a front section of the swing body 2, an arm 12 coupled pivotably with the tip of the boom 11, and a bucket 13 coupled pivotably with the tip of the arm 12.

The hydraulic excavator also includes left and right travel motors 15, a swing motor 16, boom cylinders 17, an arm cylinder 18 and a bucket cylinder 19. These are hydraulic actuators. The left and right travel motors 15 drive the left and right crawlers 4 of the track structure 1, respectively. The swing motor 16 drives the slewing ring 6 and swings the swing body 2 relative to the track structure 1. The boom cylinders 17 drive the boom 11 up and down. The arm cylinder 18 drives the arm 12 toward the dumping side (opening side) and the crowding side (shovel-in side). The bucket cylinder 19 drives the bucket 13 toward the dumping side and the crowding side.

Hydraulic System

Figure 2:
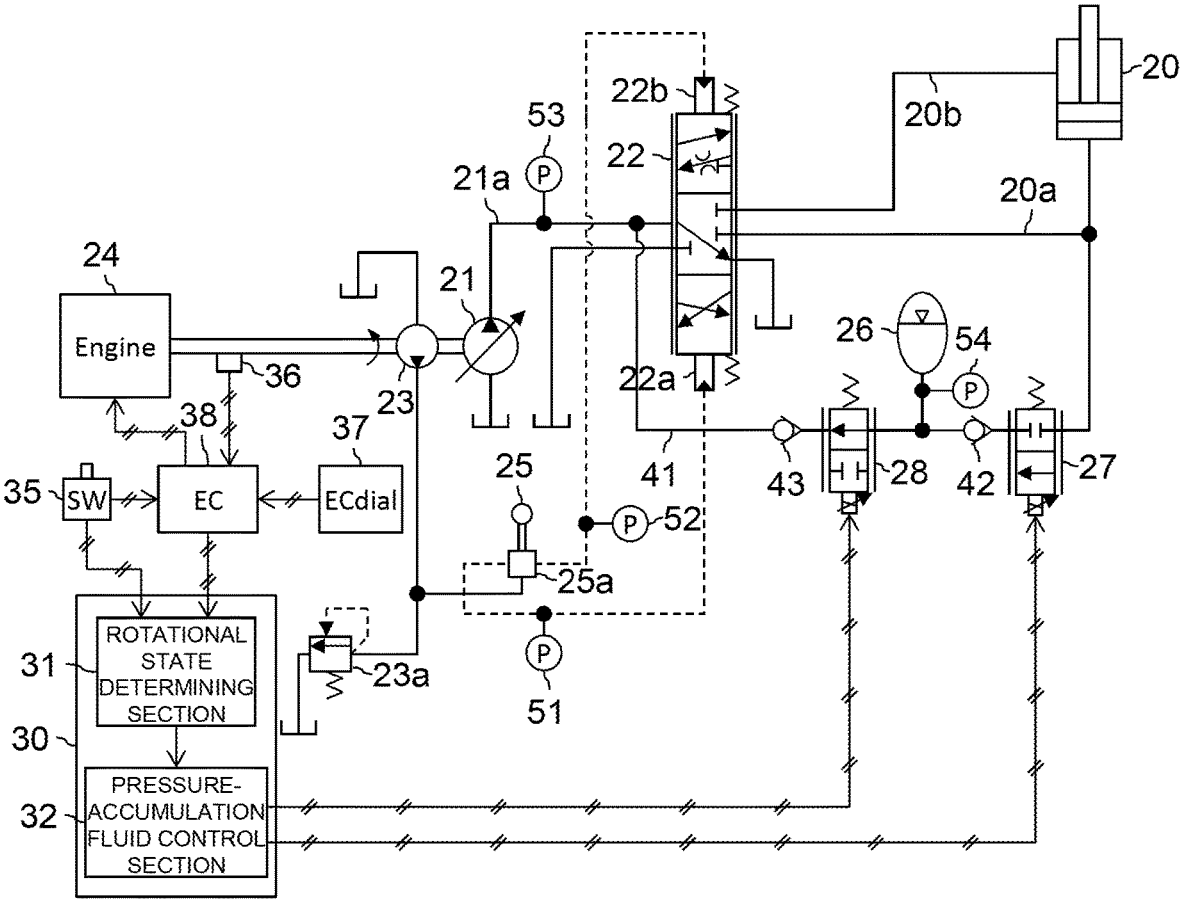
FIG. 2 is a circuit diagram illustrating main sections of a hydraulic system provided to the work machine according to a first embodiment of the present invention.

FIG. 2 is a circuit diagram illustrating main sections of a hydraulic system provided to the work machine according to a first embodiment of the present invention. As illustrated in the figure, the work machine illustrated in FIG. 1 includes a hydraulic system configured to drive a hydraulic cylinder 20. The hydraulic cylinder 20 is a hydraulic actuator configured to drive the work implement 3, and can be the arm cylinder 18 or bucket cylinder 19 although the hydraulic cylinder 20 is explained as being the boom cylinder 17 in the present embodiment. This hydraulic system includes a hydraulic pump 21, a control valve 22, a pilot pump 23, an engine 24, the operation device 25, an accumulator 26, control valves 27 and 28, a hydraulic system controller 30 and the like.

The hydraulic pump 21 is, for example, a variable displacement pump, and sucks in a hydraulic operating fluid stored in a tank and delivers the hydraulic operating fluid to a delivery line 21*a* as a hydraulic fluid to drive the hydraulic cylinder 20. The delivery line 21*a* is connected to the control valve 22. Although not illustrated, the delivery line 21*a* is provided with a relief valve, and the relief valve regulates a maximum pressure of the delivery line 21*a*. The pilot pump 23 is of a fixed displacement type, and outputs a pilot pressure to serve as a source pressure of an operation signal to drive the control valve 22. The drive axes of the hydraulic pump 21 and pilot pump 23 are coupled with an output axis of the engine 24, and the hydraulic pump 21 and pilot pump 23 are driven by the engine 24. A delivery line of the pilot pump 23 is provided with a pilot relief valve 23*a*, and the pilot relief valve 23*a* regulates an upper limit value of the pilot pressure.

The engine 24 is a prime mover, and is an internal combustion engine such as a diesel engine. In addition, the engine 24 is activated according to an operation of an engine switch (prime mover switch) 35 such as a key switch, and the revolution speed (engine revolution speed N) of the engine 24 is sensed at a revolution speed sensor 36. The engine revolution speed N (target revolution speed Nt) at the time of operation is set using an engine control dial 37. Signals from the engine switch 35, revolution speed sensor 36 and engine control dial 37 are input to an engine controller (prime mover controller) 38, and the engine controller 38 controls the engine 24 according to these signals. For example, while a signal as a command for activation (operation) is being input from the engine switch 35, the engine controller 38 controls a fuel injection amount, and so on such that the engine revolution speed N, which is a sensing result (sensing signal) from the revolution speed sensor 36, approaches the target revolution speed Nt set using the engine control dial 37. In addition, beside the engine revolution speed N input from the revolution speed sensor 36, based on the engine revolution speed N sensed at the revolution speed sensor 36, the engine controller 38 outputs, to a rotational state determining section 31 of the hydraulic system controller 30, a determination signal F1 about a rotational state of the engine 24. The determination signal F1 about the rotational state of the engine 24 is, for example, a signal that identifies whether or not a revolution speed is insufficient for the work machine to work. The revolution speed insufficient for the work machine to work is, for example, a revolution speed lower than a set value Ns set relative to the target revolution speed Nt of the engine revolution speed N, for example, set lower than Nt. A situation where an engine is about to stall or a situation where an engine has stalled can also be determined based on this set value Ns.

The operation device 25 is a hydraulic pilot-type lever device that, according to an operation, generates an operation signal (hydraulic signal) to reduce the pilot pressure output from the pilot pump 23 and drive the control valve 22. The operation device 25 is configured to operate a pilot valve (pressure reducing valve) 25*a* with an operation lever. The pilot pump 23 is connected to a primary port of the pilot valve 25*a*, and operation ports 22*a* and 22*b* of the control valve 22 are connected to two secondary ports, respectively, provided corresponding to lever operation directions. If the operation lever is operated to tilt toward one side, the pilot pressure of the pilot pump 23 is reduced according to the operation amount, and an operation signal generated thereby is output to the operation port 22*a* of the control valve 22. If the operation lever is operated to tilt toward the other side, an operation signal generated similarly is output to the operation port 22*b* of the control valve 22.

The control valve 22 is a directional control valve that controls a flow of the hydraulic fluid from the hydraulic pump 21 to the hydraulic cylinder 20, and, in the present embodiment, is constituted by a hydraulically-driven three-position selector valve. The control valve 22 is connected to a bottom fluid chamber of the hydraulic cylinder 20 via a bottom line 20*a*, to a rod fluid chamber of the hydraulic cylinder 20 via a rod line 20*b*, and to the tank via a tank line. By a spool of the control valve 22 being driven, the connection destination to which the delivery line 21*a* of the hydraulic pump 21 is connected is switched to at least one of the bottom fluid chamber, the rod fluid chamber and the tank. Specifically, the spool of the control valve 22 is pressed by springs from both sides, and, when not being operated, the spool is at its neutral position, and connects the delivery line 21*a* only to the tank. For example, if an operation signal is input to the operation port 22*a* of the control valve 22, the spool moves upward in the figure, and the delivery line 21*a* is connected to the tank line and the bottom line 20*a*. Along with an increase of the spool moving amount, the proportion of flow to the bottom line 20*a* increases, and the flow rate of supply to the bottom fluid chamber increases. If the hydraulic fluid is supplied to the bottom fluid chamber, the hydraulic cylinder 20 is elongated, the boom 11 rises, and a return fluid pushed out from the rod fluid chamber is discharged to the tank via the control valve 22. In contrast, if an operation signal is input to the operation port 22*b* of the control valve 22, the spool moves down in the figure, and the delivery line 21*a* is connected to the tank line and the rod line 20*b*. Along with an increase of the spool moving amount, the proportion of flow to the rod line 20*b* increases, and the flow rate of supply to the rod fluid chamber increases. If the hydraulic fluid is supplied to the rod fluid chamber, the hydraulic cylinder 20 contracts, the boom 11 moves down, and the return fluid pushed out from the bottom fluid chamber is discharged to the tank via the control valve 22.

The accumulator 26 is a regenerating device configured to accumulate, as regenerative energy, a return hydraulic fluid pushed out from the bottom fluid chamber of the hydraulic cylinder 20 when the work implement 3 moves down. In the present embodiment, the bottom fluid chamber (bottom line 20*a*) of the hydraulic cylinder 20 and the delivery line 21*a* of the hydraulic pump 21 are connected by a bypass line 41, bypassing the control valve 22. The accumulator 26 is placed in this bypass line 41. In addition, the bypass line 41 is provided with the pressure-accumulation control valve 27 such that it is positioned between the bottom fluid chamber of the hydraulic cylinder 20 and the accumulator 26, and additionally the bypass line 41 is provided with a release control valve 28 such that it is positioned between the accumulator 26 and the delivery line 21*a* of the hydraulic pump 21. These control valves 27 and 28 are electromagnetically-driven control valves that are driven by command signals from a pressure-accumulation fluid control section 32 of the hydraulic system controller 30, and may be on-off valves, but in the present embodiment proportional solenoid valves are used. The pressure-accumulation control valve 27 in the present embodiment is a normally-closed solenoid valve, and at normal time interrupts connection between the accumulator 26 and the bottom fluid chamber of the hydraulic cylinder 20. If the solenoid is excited by a command signal from the pressure-accumulation fluid control section 32, the control valve 27 is opened to connect the bottom fluid chamber of the hydraulic cylinder 20 to the accumulator 26. The release control valve 28 is a normally-open solenoid valve, and at normal time connects the accumulator 26 to the delivery line 21*a* of the hydraulic pump 21. If the solenoid is excited by a command signal from the pressure-accumulation fluid control section 32, the control valve 28 is closed to interrupt connection between the accumulator 26 and the delivery line 21*a* of the hydraulic pump 21.

Note that a check valve 42 is provided between the pressure-accumulation control valve 27 and the accumulator 26, and a check valve 43 is provided between the release control valve 28 and the delivery line 21*a* of the hydraulic pump 21. These check valves 42 and 43 limit the fluid-circulation direction of the bypass line 41 to only the direction to merge with the delivery line 21*a* of the hydraulic pump 21. Thereby, a delivered fluid from the hydraulic pump 21 does not flow into the accumulator 26, and the pressure-accumulation fluid in the accumulator 26 does not flow into the bottom line 20*a* of the hydraulic cylinder 20.

In addition, the pilot line establishing communication between the operation port 22*a* of the control valve 22 and the pilot valve 25*a* is provided with a pressure sensor 51 that measures a pressure applied to the operation port 22*a* (a magnitude of an operation signal P1 instructing to cause elongation of the hydraulic cylinder 20). Similarly, the pilot line establishing communication between the operation port 22*b* of the control valve 22 and the pilot valve 25*a* is provided with a pressure sensor 52 that measures a pressure applied to the operation port 22*b* (a magnitude of an operation signal P2 instructing to cause contraction of the hydraulic cylinder 20). A section upstream of the control valve 22 in the delivery line 21*a* of the hydraulic pump 21 is provided with a pressure sensor 53 that measures delivery pressure of the hydraulic pump 21. In addition, a section sandwiched by the check valve 42, the release control valve 28 and the accumulator 26 in the bypass line 41 is provided with a pressure sensor 54 that measures a pressure of the pressure-accumulation fluid in the accumulator 26. These pressure sensors 51 to 54 are electrically connected to the hydraulic system controller 30, and sensing signals from the pressure sensors 51 to 54 are input to the hydraulic system controller 30.

The hydraulic system controller 30 is a controller having a function of performing control as a pressure-accumulation fluid releasing system that opens the release control valve 28 if the engine revolution speed N becomes lower than the set value Ns. This hydraulic system controller 30 at least includes the rotational state determining section 31 and the pressure-accumulation fluid control section 32. Note that, in the present specification, if it is stated that "the engine revolution speed N is lower than the set value Ns", this includes also that the engine revolution speed N is estimated as being lower than the set value Ns, in addition to strictly that the engine revolution speed N sensed at the revolution speed sensor 36 is lower than the set value Ns. This is mentioned below in a second embodiment or the like. The set values Ns and Ps (mentioned below) or the like are set in advance, individually stored in the rotational state determining section 31, pressure-accumulation fluid control section 32, or another storage device provided to the hydraulic system controller 30, and referred to by the rotational state determining section 31 and pressure-accumulation fluid control section 32 when necessary.

The rotational state determining section 31 determines whether or not the engine revolution speed N is lower than the set value Ns, and outputs an identification signal F2 which is a result of the determination (for identification of the result of the determination). The rotational state determining section 31 in the present embodiment calculates the engine revolution speed N based on a signal from the revolution speed sensor 36, and determines whether or not the engine revolution speed N is lower than the set value Ns. At that time, when the rotational state determining section 31 outputs an identification signal F2 identifying the engine revolution speed N being lower than the set value Ns, it is presumed that the rotational state determining section 31 has made determination about an activation command signal (operation command signal) Se from the engine switch 35, and a command for activation (operation) of the engine 24 has been issued. In addition, the rotational state determining section 31 outputs the identification signal F2 not simply by determining whether or not the engine revolution speed N is lower than the set value Ns, but also taking into consideration the determination signal F1 from the engine controller 38. Specifically, if a rotational state of the engine 24 is determined as being unfavorable based on the determination signal F1, the rotational state determining section 31 estimates that the engine revolution speed N is lower than the set value Ns, and outputs an identification signal F2 (=1) identifying the engine revolution speed N being estimated as being lower than the set value Ns. In summary, the rotational state determining section 31 outputs an identification signal F2 (=1) indicating that the engine 24 is determined as being in a rotation abnormality state when the engine controller 38 makes such determination, in addition to when the rotational state determining section 31 itself makes such determination.

The pressure-accumulation fluid control section 32 controls the amount of fluid supplied to the accumulator 26 or discharged from the accumulator 26 by controlling an opening degree of the control valves 27 and 28, and issues commands for collecting and regenerating potential energy of the work implement 3. This pressure-accumulation fluid control section 32 has the function of outputting a command signal for opening the release control valve 28 if the engine revolution speed N is determined as being lower than the set value Ns based on the identification signal F2 of the rotational state determining section 31.

Control Procedure

Figure 3:
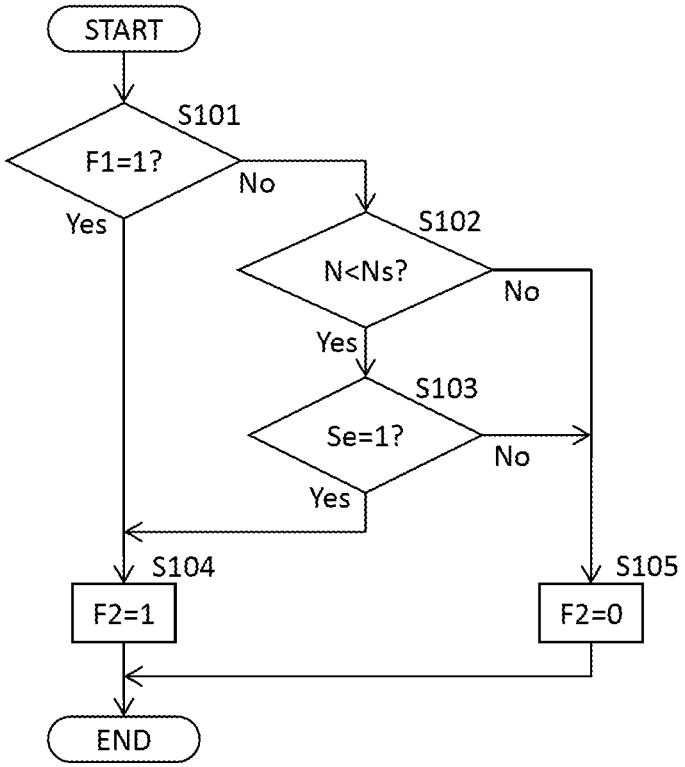
FIG. 3 is a flowchart illustrating a procedure of outputting an identification signal by a rotational state determining section provided to the work machine according to the first embodiment of the present invention.

FIG. 3 is a flowchart illustrating a procedure of outputting an identification signal by the rotational state determining section 31. A series of processes illustrated in the figure is executed repeatedly at predetermined cycle time (for example, 0.1 s) by the rotational state determining section 31 while the hydraulic system controller 30 is being powered.

Upon activation of the hydraulic system controller 30, the rotational state determining section 31 starts the procedures in FIG. 3, and first, at Step S101, determines whether or not the determination signal F1 from the engine controller 38 notifies an abnormality of a rotational state of the engine 24 (F1=1). If the determination signal F1 notifies an abnormality (F1=1), the process proceeds to Step S104, and if the determination signal F1 notifies normality (F1=0), the process proceeds to Step S102.

If the process proceeds to Step S102, the rotational state determining section 31 calculates the engine revolution speed N based on a signal sensed at the revolution speed sensor 36, and determines whether the engine revolution speed N is lower than the set value Ns. If the engine revolution speed N is lower than the set value Ns (if N≤Ns), the process proceeds to Step S103, and if the engine revolution speed N is equal to or higher than the set value Ns (if N≤Ns), the process proceeds to Step S105. If the process proceeds to Step S103, the rotational state determining section 31 determines whether an activation command signal Se from the engine switch 35 is in the ON state (Se=1). If the activation command signal Se is in the ON state (Se=1), the process proceeds to Step S104, and if the activation command signal Se is in the OFF state (Se=0), the process proceeds to Step S105. If the process proceeds to Step S104, the rotational state determining section 31 outputs an identification signal F2 (F2=1) identifying a rotational state of the engine 24 being abnormal to the pressure-accumulation fluid control section 32, and ends the procedures in FIG. 3. If the process proceeds to Step S105, the rotational state determining section 31 outputs an identification signal F2 (F2=0) indicating that the rotational state of the engine 24 is identified as being normal to the pressure-accumulation fluid control section 32, and ends the procedures in FIG. 3.

According to the procedures in FIG. 3, if, although the engine controller 38 does not notify a rotation abnormality of the engine, a command for activation of the engine has been issued, but the engine revolution speed is low (F1=0, Se=1, and N<Ns), a rotational state of the engine 24 is determined as being abnormal. The same applies also if the engine controller 38 notifies a rotation abnormality of the engine 24 (F1=1). On the other hand, if the rotation abnormality of the engine 24 is not notified, and the engine revolution speed is sufficient (F1=0, and N≤Ns), the rotational state of the engine 24 is determined as being normal. In addition, if, although the rotation abnormality of the engine 24 is not notified, the engine revolution speed is low, but first of all an activation command of the engine 24 has not been issued (F1=0, N<Ns, and Se=0), similarly the rotational state of the engine 24 is determined as being normal.

Figure 4:
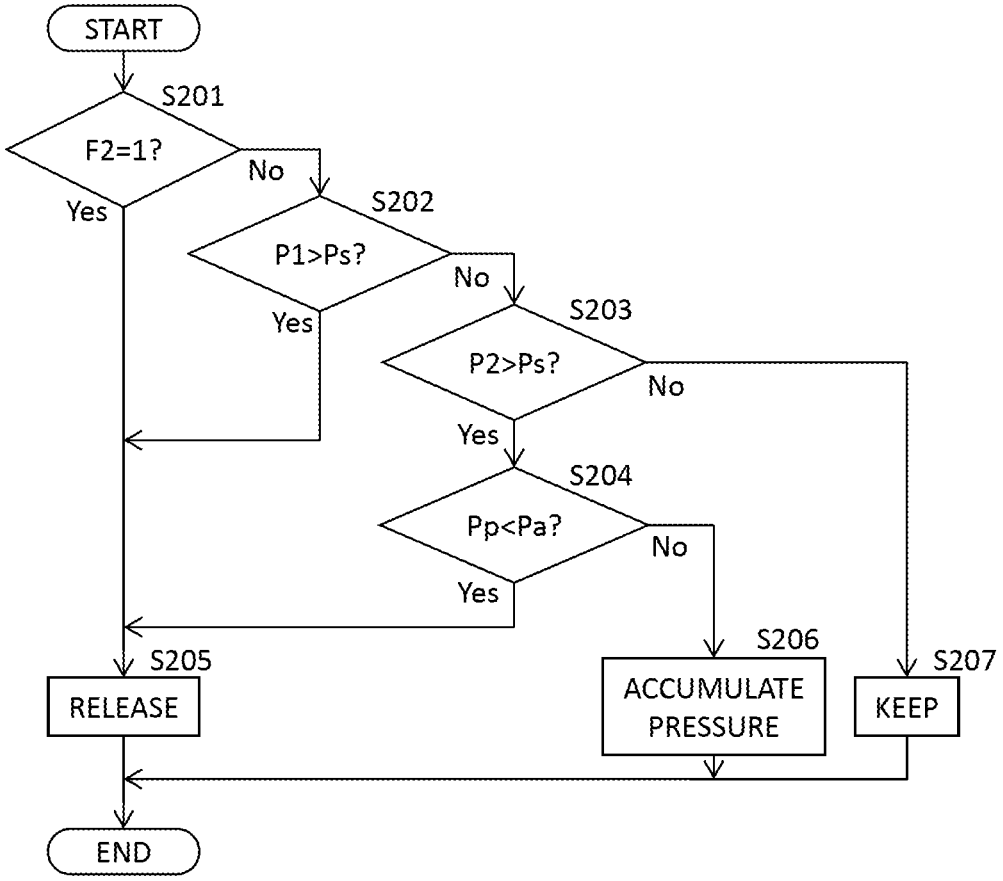
FIG. 4 is a flowchart illustrating a procedure of controlling a pressure-accumulation fluid amount by a pressure-accumulation fluid control section provided to the work machine according to the first embodiment of the present invention.

FIG. 4 is a flowchart illustrating a procedure of controlling a pressure-accumulation fluid amount by the pressure-accumulation fluid control section 32. A series of processes illustrated in the figure is executed repeatedly at predetermined cycle time (for example, 0.1 s) by the pressure-accumulation fluid control section 32 while the hydraulic system controller 30 is being powered.

Upon activation of the hydraulic system controller 30, the pressure-accumulation fluid control section 32 starts the procedures in FIG. 4, and first, at Step S201, determines whether or not the identification signal F2 from the rotational state determining section 31 is a signal identifying an abnormality of a rotational state of the engine 24 (F2=1). If F2 notifies the abnormality (F2=1), the process proceeds to Step S205, and if F2 notifies normality (F2=0), the process proceeds to Step S202.

If the process proceeds to Step S202, the pressure-accumulation fluid control section 32 determines whether the operation signal P1 sensed at the pressure sensor 51 is larger than the set value Ps (that is, whether an operation of elongating the hydraulic cylinder 20 is being performed). If the operation signal P1 is larger than the set value Ps (if P1>Ps), the process proceeds to Step S205, and if the operation signal P1 is equal to or lower than the set value Ps (if P1≤Ps), the process proceeds to Step S203. If the process proceeds to Step S203, the pressure-accumulation fluid control section 32 determines whether the operation signal P2 sensed at the pressure sensor 52 is larger than the set value Ps (that is, whether an operation of contracting the hydraulic cylinder 20 is being performed). If the operation signal P2 is larger than the set value Ps (if P2>Ps), the process proceeds to Step S204, and if the operation signal P2 is equal to or lower than the set value Ps (if P2≤Ps), the process proceeds to Step S207. If the process proceeds to Step S204, the pressure-accumulation fluid control section 32 determines whether a delivery pressure Pp of the hydraulic pump 21 sensed at the pressure sensor 53 is lower than a pressure Pa of the pressure-accumulation fluid in the accumulator 26 sensed at the pressure sensor 54 (Pp<Pa). If the delivery pressure Pp is lower than the pressure Pa (Pp<Pa), the process proceeds to Step S205, and if the delivery pressure Pp is equal to or higher than the pressure Pa, the process proceeds to Step S206.

If, as a result of the determination at Steps S201 to S204, an abnormality of the engine 24 is first identified based on the identification signal F2, the pressure-accumulation fluid control section 32 executes the procedure at Step S205 and ends the procedures in FIG. 4. Even in a case where the abnormality of the engine 24 is not identified, if an elongating operation of the hydraulic cylinder 20 is being performed, the pressure-accumulation fluid control section 32 executes the procedure at Step S205 and ends the procedures in FIG. 4. In addition, in a case where the engine 24 is normal, if a contracting operation of the hydraulic cylinder 20 is being performed, and the delivery pressure Pp is lower than the pressure Pa of the pressure-accumulation fluid in the accumulator 26, the pressure-accumulation fluid control section 32 executes the procedure at Step S205 and ends the procedures in FIG. 4. Step S205 is a process of releasing the pressure-accumulation fluid in the accumulator 26. At Step S205, the pressure-accumulation fluid control section 32 degausses the control valves 27 and 28 to close the pressure-accumulation control valve 27 and simultaneously open the release control valve 28 to attain the state illustrated in FIG. 2. Thereby, connection between the accumulator 26 and the bottom fluid chamber of the hydraulic cylinder 20 is interrupted, and the accumulator 26 is connected to the delivery line 21*a* of the hydraulic pump 21. In the case where the engine 24 is normal, and an elongating operation of the hydraulic cylinder 20 is being performed (in a case where Step S205 is executed via Step S202), if the delivery pressure Pp of the hydraulic pump 21 is lower than the pressure Pa of the pressure-accumulation fluid, regeneration is performed. That is, the pressure-accumulation fluid merges with the delivered fluid from the hydraulic pump 21, and is supplied to the hydraulic cylinder 20 via the control valve 22. At that time, even if the delivery pressure Pp is higher than the pressure Pa, the delivered fluid from the hydraulic pump 21 does not flow reversely into the accumulator 26. Also, if the engine 24 is normal, a contracting operation of the hydraulic cylinder 20 is being performed, and the delivery pressure Pp of the hydraulic pump 21 is lower than the pressure Pa of the pressure-accumulation fluid (if Step S205 is executed via Step S204), regeneration is performed similarly. If a rotation abnormality of the engine 24 is identified (if the process of Step S205 is executed without going through the determination at Steps S202 and S204), the pressure-accumulation fluid in the accumulator 26 is returned to the tank via the control valve 22.

In addition, in a case where the engine 24 is normal, and a contracting operation of the hydraulic cylinder 20 is being performed, if the delivery pressure Pp is equal to or higher than the pressure Pa of the pressure-accumulation fluid in the accumulator 26, the pressure-accumulation fluid control section 32 executes the procedure at Step S206 and ends the procedures in FIG. 4. Step S206 is a process of accumulating the return hydraulic fluid from the hydraulic cylinder 20 in the accumulator 26 (pressure-accumulation process). At Step S206, the pressure-accumulation fluid control section 32 excites the control valves 27 and 28 to open the pressure-accumulation control valve 27 and simultaneously close the release control valve 28. Thereby, connection between the delivery line 21*a* of the hydraulic pump 21 and the accumulator 26 is interrupted, and the bottom fluid chamber of the hydraulic cylinder 20 is connected to the accumulator 26. Thereby, the hydraulic fluid pushed out from the bottom fluid chamber of the hydraulic cylinder 20 flows into the accumulator 26, and pressure accumulation is performed. Even if a pressure in the bottom fluid chamber of the hydraulic cylinder 20 is lower than the pressure Pa, the pressure-accumulation fluid in the accumulator 26 does not flow into the bottom line 20*a* due to the check valve 42.

If an abnormality of the engine is not identified, and the operation device 25 is not being operated, the pressure-accumulation fluid control section 32 executes the procedure at Step S207 and ends the procedures in FIG. 4. Step S207 is a process of keeping the pressure-accumulation fluid in the accumulator 26 if the engine 24 is not being operated in an occasion where it is activated normally (none of pressure-accumulation and regeneration are performed). At Step S207, the pressure-accumulation fluid control section 32 degausses the control valve 27 and simultaneously excites the control valve 28 to close both the control valves 27 and 28. Thereby, both connection between the accumulator 26 and the delivery line 21*a* of the hydraulic pump 21 and connection between the accumulator 26 and the bottom fluid chamber of the hydraulic cylinder 20 are interrupted, and the pressure-accumulation fluid is kept in the accumulator 26.

Effects (1) In the present embodiment, in a case where the engine is operating at low revolution with the engine revolution speed N falling below the set value Ns including at the time of engine stalling, the process at Step S205 is executed to open the release control valve 28, and the accumulator 26 is connected to the delivery line 21*a* of the hydraulic pump 21. At this time, due to override characteristics of the pilot relief valve 23*a*, the pilot pressure output from the pilot pump 23 lowers along with decrease of an engine revolution speed. Then, the pressure (operation signals P1 and P2) that can be applied to the operation ports 22*a* and 22*b* lower, and the control valve 22 takes a neutral position irrespective of whether or not the operation device 25 is being operated. Thereby, the pressure-accumulation fluid in the accumulator 26 flows down to the tank through the release control valve 28, check valve 43 and control valve 22. That is, in a case where the engine 24 stops or in other cases, even if the engine 24 is not reactivated and an operator gets off the machine, communication is established with the tank via the control valve 22 that returns to the neutral position hydraulically naturally; thereby, the pressure-accumulation fluid in the accumulator 26 is automatically released. Accordingly, in the case where the engine 24 stops or in other cases, dissolution of gas in a gas chamber in the accumulator 26 into the pressure-accumulation fluid can be suppressed even if it is forgotten to perform the procedure of releasing the pressure-accumulation fluid in the accumulator 26. In addition, due to the pressure-accumulation fluid in the accumulator 26 being released, unexpected spouting of the hydraulic fluid, for example, during maintenance works of the accumulator 26 or hydraulic conduits can also be prevented.

(2) In the present embodiment, a configuration is adopted in which the engine controller 38 determines a rotational state of the engine 24, and, in addition to this, the rotational state determining section 31 is provided, and the rotational state determining section 31 also determines the rotational state of the engine 24 separately. By determining the rotational state of the engine 24 at two stages in this manner, an abnormality of the rotational state of the engine 24 which could not be detected at the engine controller 38 can be detected at the rotational state determining section 31. Thereby, occasions of forgetting to release the pressure-accumulation fluid in the accumulator 26 can be more surely reduced.

Note that if the necessity for determining a rotational state of the engine 24 at two stages is low, either the determination by the engine controller 38 or the determination by the rotational state determining section 31 may be eliminated from basic information about pressure-accumulation fluid control. If the determination by the engine controller 38 is eliminated, for example, the determination by the rotational state determining section 31 at Step S101 in the procedures in FIG. 3 is omitted. If the determination by the rotational state determining section 31 is eliminated, for example, the rotational state determining section 31 itself is omitted, and whether the determination signal F1 from the engine controller 38 is 1 or 0 is determined by the determination by the pressure-accumulation fluid control section 32 at Step S201 in the procedures in FIG. 4. In this case, the engine controller 38 is the rotational state determining section. In addition, the set values Ns used at the engine controller 38 and the rotational state determining section 31 may be the same value or may be different values. For example, if the set value Ns used at the rotational state determining section 31 is set higher than the set value Ns used at the engine controller 38, the energy efficiency may lower, but dissolution of gas into the pressure-accumulation fluid can be suppressed more.

(3) In a case where the release control valve 28 is a normally-closed valve, if a command signal is not output from the pressure-accumulation fluid control section 32 and the solenoid of the control valve 28 cannot be excited due to a failure of an electric system or the like in a case where a rotation abnormality has occurred in the engine 24, the pressure-accumulation fluid in the accumulator 26 is not released. In contrast to this, since the control valve 28 is a normally-open valve in the present embodiment, the accumulator 26 is naturally connected to the delivery line 21*a* of the hydraulic pump 21 in a situation where a command signal cannot be output from the pressure-accumulation fluid control section 32. If the engine 24 is experiencing stalling or the like at that time, the control valve 22 takes a neutral position, and the pressure-accumulation fluid can accordingly be released to the tank. Note that the release control valve 28 may be a normally-closed valve in a case where a situation in which a command signal cannot be output from the pressure-accumulation fluid control section 32 cannot be expected to occur.

Second Embodiment

Figure 5:
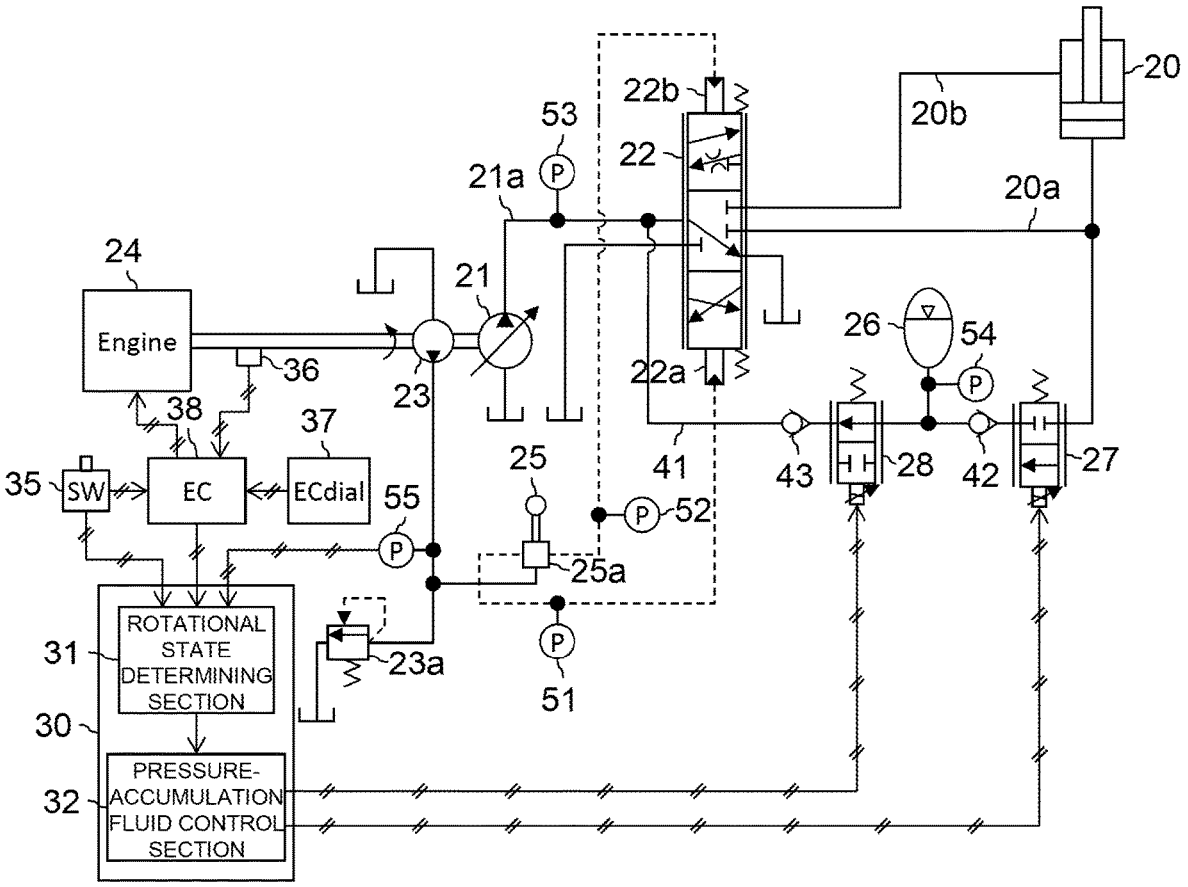
FIG. 5 is a circuit diagram illustrating main sections of a hydraulic system provided to the work machine according to a second embodiment of the present invention.

FIG. 5 is a circuit diagram illustrating main sections of a hydraulic system provided to a work machine according to a second embodiment of the present invention. The figure corresponds to FIG. 2 related to the first embodiment. In FIG. 5, elements that correspond to elements explained in the first embodiment are indicated by the same reference characters as those in FIG. 2. Differences between the present embodiment and the first embodiment is that, in the present embodiment, a pressure sensor 55 configured to sense the pilot pressure Po output by the pilot pump 23 is provided, and the rotational state determining section 31 determines whether or not the engine revolution speed N is lower than the set value Ns based on a signal from the pressure sensor 55. Since the present embodiment is similar to the first embodiment in other respects, explanations of those other respects are omitted, and differences from the first embodiment are explained below.

Since the pilot pump 23 is driven by the engine 24, the revolution speed of the pilot pump 23 changes according to the engine revolution speed N. As the revolution speed (=the engine revolution speed N) of the pilot pump 23 decreases, the pilot pressure Po lowers due to override characteristics of the pilot relief valve 23*a*. That is, the engine revolution speed N can be estimated from the pilot pressure Po, and this is a reason why the pilot pressure Po is sensed as basic information for pressure-accumulation fluid control. In the present embodiment, a signal from the pressure sensor 55 is input to the rotational state determining section 31, and if the engine revolution speed N is estimated as having lowered below the set value Ns according to a magnitude relationship between the pilot pressure Po and the set value Pq, an identification signal F2 (=1) is output. The set value Pq is the value of the pilot pressure Po when the engine revolution speed N equals the set value Ns, is set in advance to be stored in the rotational state determining section 31 or another storage device provided to the hydraulic system controller 30, and is referred to by the rotational state determining section 31 when necessary. The other configurations are similar to those in the first embodiment.

Figure 6:
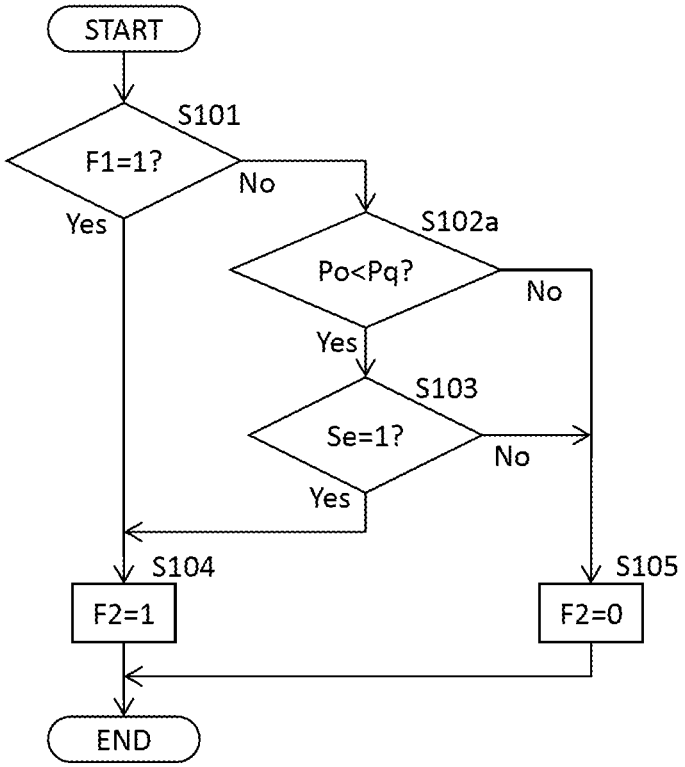
FIG. 6 is a flowchart illustrating a procedure of outputting an identification signal by the rotational state determining section provided to the work machine according to the second embodiment of the present invention.

FIG. 6 is a flowchart illustrating a procedure of outputting an identification signal by the rotational state determining section 31 in the present embodiment. The figure corresponds to FIG. 3 in the first embodiment. A series of processes illustrated in FIG. 6 is executed repeatedly at predetermined cycle time (for example, 0.1 s) by the rotational state determining section 31 while the hydraulic system controller 30 is being powered.

The procedures in FIG. 6 are different from the procedures in FIG. 3 only in that the process at Step S102 is replaced by Step S102*a*, and the other processes at Steps S101, S103 to S105 are similar to the processes with the same numbers in FIG. 3. If the determination signal F1 from the engine controller 38 indicates that the rotational state of the engine 24 is determined as being normal (F1=0), the process proceeds to Step S102. At Step S102*a*, the rotational state determining section 31 determines whether the pilot pressure Po sensed at the pressure sensor 55 is lower than the set value Pq. If the pilot pressure Po is lower than the set value Pq (if Po<Pq), the process proceeds to Step S103, and if the pilot pressure Po is equal to or higher than the set value Pq (if Po≥Pq), the process proceeds to Step S105. If Po<Pq, it is estimated that N<Ns, and if at the subsequent Step S103 the activation command signal Se=1, it can be said that the engine 24 is not rotating normally despite the fact that an attempt is being made to operate the engine 24, and the rotational state is determined as being abnormal at Step S104 (F2=1). Needless to say, if Po≥Pq, it is estimated that N≥Ns, and the rotational state of the engine 24 is determined as being normal at Step S105 (F2=0).

The procedure of the pressure-accumulation fluid control section 32 is similar to that in the first embodiment. In the present embodiment also, effects similar to those in the first embodiment can be attained.

Third Embodiment

Figure 7:
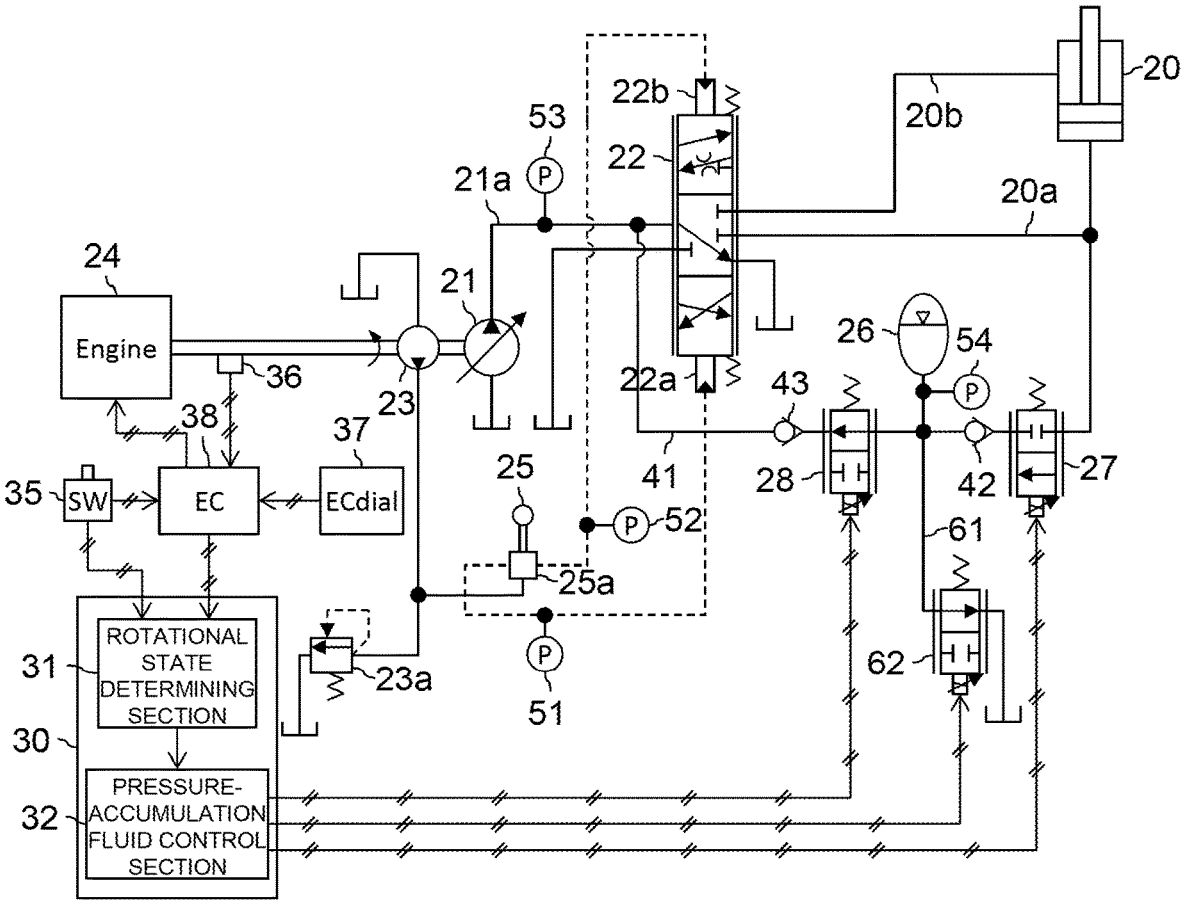
FIG. 7 is a circuit diagram illustrating main sections of the hydraulic system provided to the work machine according to a third embodiment of the present invention.

FIG. 7 is a circuit diagram illustrating main sections of the hydraulic system provided to the work machine according to a third embodiment of the present invention. The figure corresponds to FIG. 2 related to the first embodiment. In FIG. 7, elements that correspond to the elements explained in the first embodiment are indicated by the same reference characters as those in FIG. 2. A difference between the present embodiment and the first embodiment is that a tank line 61 and a tank valve 62 are added in the present embodiment. Since the present embodiment is similar to the first embodiment in other respects, explanations of those other respects are omitted, and difference from the first embodiment is explained below.

The tank line 61 branches off from between the control valves 27 and 28 in the bypass line 41 (strictly speaking, between the check valve 42 and the release control valve 28), and is connected to the tank without passing through the control valve 22 (bypassing the control valve 22). The tank valve 62 is a normally-open, electromagnetically-driven on-off valve, and is provided at a point in the tank line 61. The tank valve 62 is driven by a command signal from the pressure-accumulation fluid control section 32 and opens and closes the tank line 61. Although an oil filter (not illustrated) or a check valve for preventing reverse flow (not illustrated) may be provided in the tank line 61, other control valves or the like than the tank valve 62 are not provided in the present embodiment (note that they may be provided as necessary). Then, the pressure-accumulation fluid control section 32 in the present embodiment executes a process of opening the tank valve 62 together with the control valve 28 when the release control valve 28 is opened if the engine revolution speed N is identified as being lower than the set value Ns.

Figure 8:
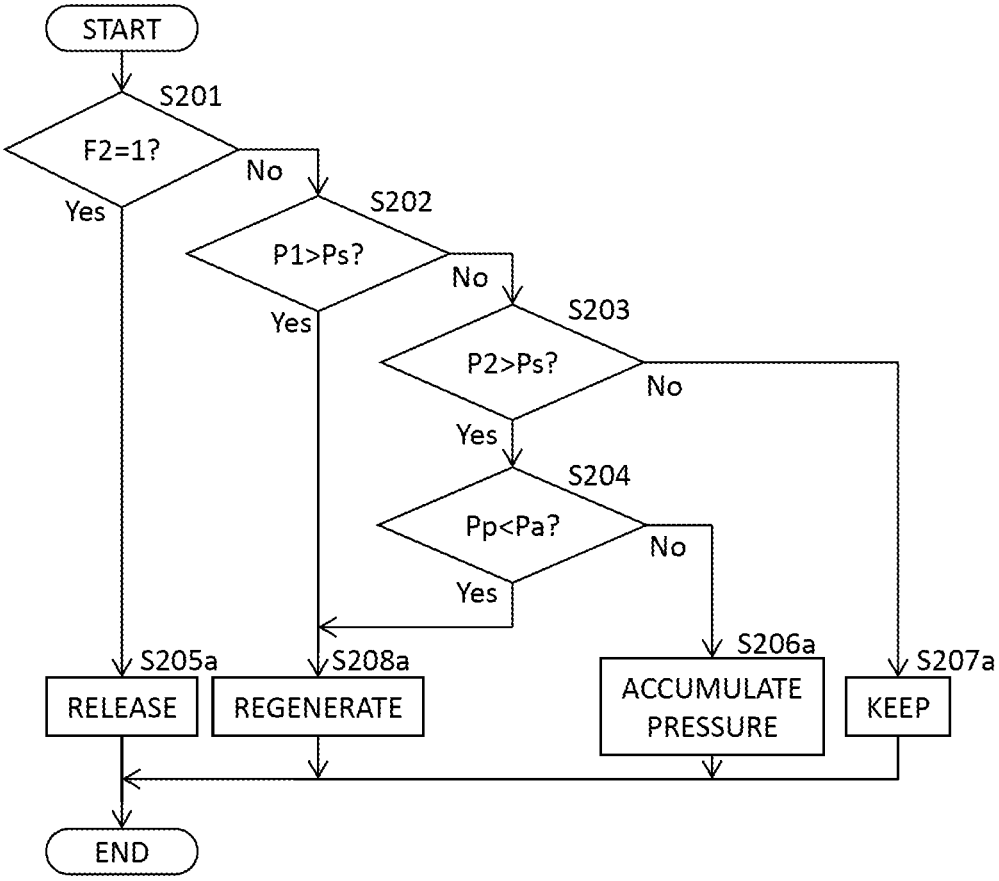
FIG. 8 is a flowchart illustrating a procedure of controlling a pressure-accumulation fluid amount by the pressure-accumulation fluid control section provided to the work machine according to the third embodiment of the present invention.

FIG. 8 is a flowchart illustrating a procedure of controlling a pressure-accumulation fluid amount by a pressure-accumulation fluid control section provided to a work machine according to the third embodiment of the present invention. The figure corresponds to FIG. 4 related to the first embodiment. A series of processes illustrated in the figure is executed repeatedly at predetermined cycle time (for example, 0.1 s) by the pressure-accumulation fluid control section 32 while the hydraulic system controller 30 is being powered. The procedures in FIG. 8 are different from the procedures in FIG. 4 in that the processes at Steps S205 to S207 are replaced by processes at Steps S205*a* to S207*a*, and additionally a process at Step S208*a* is added. In the other respects, the present embodiment is similar to the first embodiment (FIG. 4).

In the present embodiment, if, as a result of the determination at Steps S201 to S204, an abnormality of the engine 24 is first identified based on the identification signal F2, the pressure-accumulation fluid control section 32 executes a procedure at Step S205*a* and ends the procedures in FIG. 8. Step S205*a* is a process of releasing the pressure-accumulation fluid in the accumulator 26, and the process of releasing in the present embodiment is different from the process of releasing in the first embodiment. At Step S205*a*, the pressure-accumulation fluid control section 32 degausses the control valves 27 and 28 and the tank valve 62 to close the pressure-accumulation control valve 27 and simultaneously open the release control valve 28 and tank valve 62 to attain the state illustrated in FIG. 7. At the time of execution of Step S205*a*, the control valve 22 takes a neutral position along with a decrease of the engine revolution speed N as mentioned above. Thereby, connection between the accumulator 26 and the bottom fluid chamber of the hydraulic cylinder 20 is interrupted, the accumulator 26 is connected to the tank via the bypass line 41 and tank line 61, and the pressure-accumulation fluid is released.

In addition, in the present embodiment, if a result of the determination at Step S202 is positive, or a result of the determination at Step S202 is not positive, but results of the determination at Steps S203 and S204 are positive, the pressure-accumulation fluid control section 32 executes the process at Step S208*a* and ends the procedures in FIG. 8. Step S208*a* is a process of regeneration, and a behavior of the pressure-accumulation fluid is similar to that in the releasing process executed at the time of operation in the first embodiment. At Step S208*a*, the pressure-accumulation fluid control section 32 degausses the control valves 27 and 28 and excites the tank valve 62 to close the pressure-accumulation control valve 27 and tank valve 62 and simultaneously open the release control valve 28. Since, at the time of execution of Step S208*a*, the control valve 22 is driven, the pressure-accumulation fluid in the accumulator 26 merges with the delivered fluid from the hydraulic pump 21, and drives the hydraulic cylinder 20.

In addition, if the delivery pressure Pp is equal to or higher than the pressure Pa of the accumulator 26 at the time of a contracting operation of the hydraulic cylinder 20, the pressure-accumulation fluid control section 32 proceeds to a procedure at Step S206*a* through Steps S201 to S204, executes a process of pressure-accumulation, and ends the procedures in FIG. 8. The behavior of the pressure-accumulation fluid when Step S206*a* is executed is similar to the behavior of the pressure-accumulation fluid when Step S206 in the first embodiment is executed. At Step S206*a*, the pressure-accumulation fluid control section 32 excites the control valves 27 and 28 and tank valve 62 to open the pressure-accumulation control valve 27 and simultaneously close the release control valve 28 and tank valve 62.

In addition, if an operation of the operation device 25 is not detected, the pressure-accumulation fluid control section 32 proceeds to a procedure at Step S207*a* through Steps S201 to S203, executes a process of keeping the pressure-accumulation fluid, and ends the procedures in FIG. 8. The behavior of the pressure-accumulation fluid when Step S207*a* is executed is similar to the behavior of the pressure-accumulation fluid when Step S207 in the first embodiment is executed. At Step S207*a*, the pressure-accumulation fluid control section 32 degausses the control valve 27, and excites the control valve 28 and tank valve 62 to close the control valves 27 and 28 and tank valve 62.

Procedures related to the rotational state determining section 31 are similar to those in the first embodiment. In the present embodiment, in addition to effects similar to those in the first embodiment, the tank valve 62 is opened in addition to the release control valve 28 at the time of execution of Step S205*a*. Since the accumulator 26 is connected to the tank, bypassing the control valve 22, by opening the tank valve 62, the pressure-accumulation fluid can be surely released even if for some reason the control valve 22 does not return to its neutral position at the time of engine abnormality. In addition, in addition to its certainty about discharge of the pressure-accumulation fluid, its promptness also improves. With improvement in the promptness in terms of discharge of the pressure-accumulation fluid, pressure-accumulation time of the accumulator 26 can be shortened accumulatively while suction and discharge of the hydraulic fluid is repeated on a daily basis, and dissolution of gas into the pressure-accumulation fluid can be suppressed further. Furthermore, since the tank valve 62 is also a normally-open valve like the release control valve 28, this contributes to reduction of occasions of forgetting to release the pressure-accumulation fluid.

Fourth Embodiment

Figure 9:
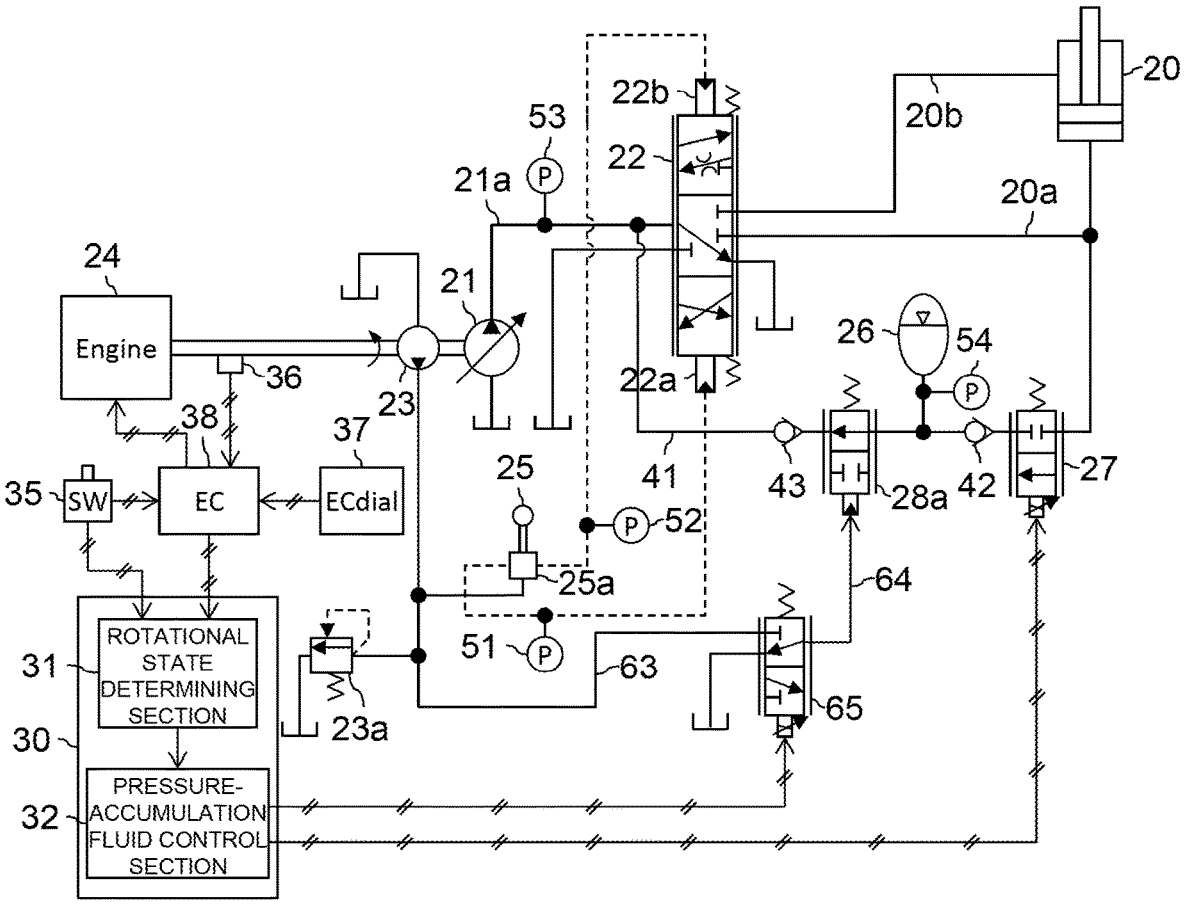
FIG. 9 is a circuit diagram illustrating main sections of the hydraulic system provided to the work machine according to a fourth embodiment of the present invention.

FIG. 9 is a circuit diagram illustrating main sections of a hydraulic system provided to a work machine according to a fourth embodiment of the present invention. The figure corresponds to FIG. 2 related to the first embodiment. In FIG. 9, elements that correspond to the elements explained in the first embodiment are indicated by the same reference characters as those in FIG. 2. A difference between the present embodiment and the first embodiment is that, in the present embodiment, a normally-open, hydraulically-driven release control valve 28*a* is used in place of the electromagnetically-driven release control valve 28. Since the present embodiment is similar to the first embodiment in other respects, explanations of those other respects are omitted, and the difference from the first embodiment is explained below.

In the present embodiment, a branch line 63 branches off from a section in the delivery line of the pilot pump 23 and upstream of the operation device 25. The branch line 63 is connected to an operation port of the release control valve 28*a* via the electromagnetically-driven selector valve 65 and the pilot line 64. The selector valve 65 is driven by a command signal from the pressure-accumulation fluid control section 32, connects the pilot line 64 to the tank at normal time (at the time when it is degaussed), and connects the pilot line 64 to the branch line 63 at the time when it is excited.

Figure 10:
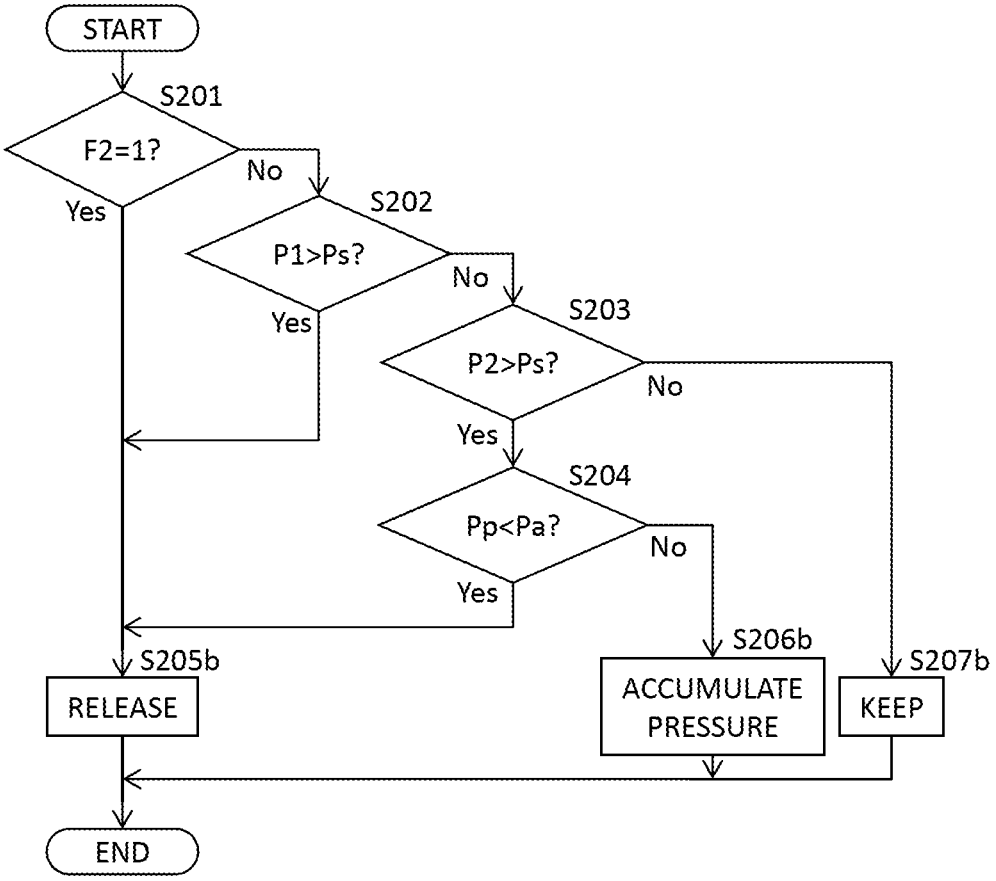
FIG. 10 is a flowchart illustrating a procedure of controlling a pressure-accumulation fluid amount by the pressure-accumulation fluid control section provided to the work machine according to the fourth embodiment of the present invention.

FIG. 10 is a flowchart illustrating a procedure of controlling a pressure-accumulation fluid amount by the pressure-accumulation fluid control section provided to the work machine according to the fourth embodiment of the present invention. The figure corresponds to FIG. 4 related to the first embodiment. A series of processes illustrated in the figure is executed repeatedly at predetermined cycle time (for example, 0.1 s) by the pressure-accumulation fluid control section 32 while the hydraulic system controller 30 is being powered. The present embodiment is different from the first embodiment in that, while command subjects at Steps S205 to S207 in the procedures in FIG. 4 are the control valves 27 and 28, command subjects at Steps S205*b* to S207*b* in the procedures in FIG. 10 are the pressure-accumulation control valve 27 and selector valve 65. In the other respects, the procedures in FIG. 10 and the procedures in FIG. 4 are the same. Note that Steps S205 to S207 and Steps S205*b* to S207*b* have a correspondent relationship, and there are no differences therebetween in the flow of the pressure-accumulation fluid. That is, the control valves 27 and 28*a* in the present embodiment directly related to suction and discharge of the pressure-accumulation fluid are opened and closed under the same conditions as those for the control valves 27 and 28 in the first embodiment.

Specifically, if F2=1 and the process proceeds to Step S205*b*, the pressure-accumulation fluid control section 32 degausses the control valve 27 and selector valve 65. If the selector valve 65 is degaussed, communication is established between the operation port and the tank via the pilot line 64 and selector valve 65 to thereby open the release control valve 28*a*. Thereby, similar to the case where Step S205 is executed in the first embodiment, the accumulator 26 is connected to the delivery line 21*a* of the hydraulic pump 21 and the pressure-accumulation fluid is released. If F2=0 and P1>Ps or if F2=0, P2>Ps, and Pp<Pa also, Step S205*b* is executed in the same way.

If F2=0, P1>Ps, P2>Ps and Pp≥Pa, the process proceeds to Step S206*b*. At Step S206*b*, the pressure-accumulation fluid control section 32 excites the control valve 27 and selector valve 65. If the selector valve 65 is excited, communication is established between the operation port and the pilot pump 23 via the pilot line 64, selector valve 65 and branch line 63 to thereby close the release control valve 28*a*. Thereby, similar to the case where Step S206 is executed in the first embodiment, the accumulator 26 is connected to the bottom fluid chamber of the hydraulic cylinder 20, and pressure accumulation is performed.

If F2=0, P1≤Ps and P2≤Ps, the process proceeds to Step S207*b*. At Step S207*b*, the pressure-accumulation fluid control section 32 degausses the control valve 27 and excites the selector valve 65. Thereby, the control valves 27 and 28*a* are closed, and similar to the case where Step S207 is executed in the first embodiment, the pressure-accumulation fluid is kept in the accumulator 26.

In the present embodiment also, effects similar to those in the first embodiment can be attained.

Fifth Embodiment

Figure 11:
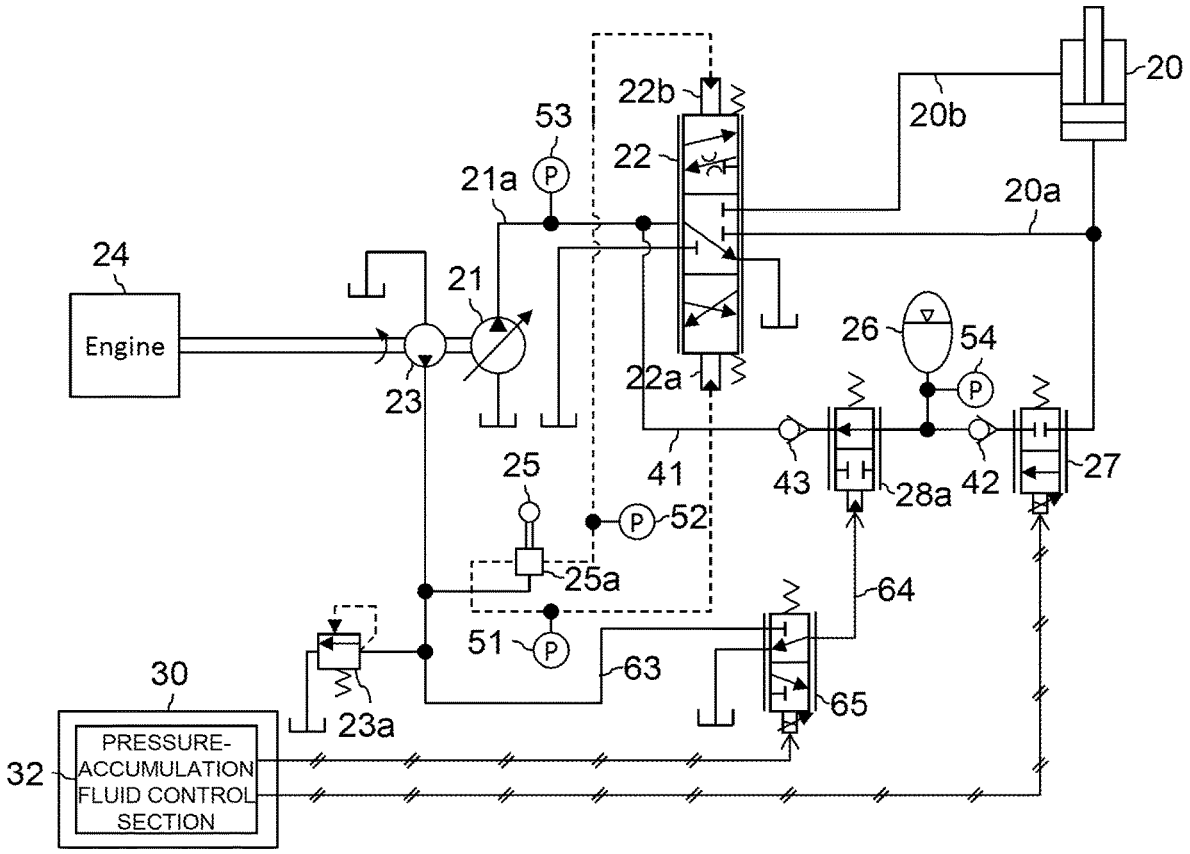
FIG. 11 is a circuit diagram illustrating main sections of the hydraulic system provided to the work machine according to a fifth embodiment of the present invention.

FIG. 11 is a circuit diagram illustrating main sections of a hydraulic system provided to a work machine according to a fifth embodiment of the present invention. The figure corresponds to FIG. 9 related to the fourth embodiment. In FIG. 11, elements that correspond to the elements explained in the fourth embodiment are indicated by the same reference characters as those in FIG. 9. A difference between the present embodiment and the fourth embodiment is that the rotational state determining section 31 of the hydraulic system controller 30 is omitted in the present embodiment. Since the present embodiment is similar to the first embodiment in other respects, explanations of those other respects are omitted, and the difference from the first embodiment is explained below.

As has been explained already, if the pilot pump 23 is driven by the engine 24, the pilot pressure Po output by the pilot pump 23 lowers as the engine revolution speed N lowers. In the present embodiment, if the pilot pressure Po lowers, the release control valve 28*a* does not operate, but takes an open position. That is, if the hydraulically-driven, normally-open control valve 28*a* configured to be closed when the pilot pressure Po is input to the operation port is used, the accumulator 26 is connected to the tank at the time of rotation abnormality of the engine 24, independent of the position of the selector valve 65. Even if the procedure of opening the release control valve 28*a* when a rotation abnormality of the engine 24 is identified at Step S201 in FIG. 4 is omitted, the control valve 28*a* is opened hydraulically naturally at the time of rotation abnormality of the engine 24 in the present embodiment. In view of this, while the function of controlling the pressure-accumulation fluid at the time of normality of the pressure-accumulation fluid control section 32 (Steps S202 to S207 in FIG. 4) is preserved, the function of releasing the pressure-accumulation fluid at the time of abnormality (Step S201) is omitted, and the hydraulically-driven control valve 28*a* itself doubles as a pressure-accumulation fluid releasing system that functions at the time of abnormality. If the process at Step S201 is omitted, the rotational state determining section 31 or devices that are utilized for a process of determination thereby are not required as long as the control valve 28*a* is operated at the time of rotation abnormality of the engine 24. Because of this, although the engine switch 35, revolution speed sensor 36, engine control dial 37 and engine controller 38 are omitted in FIG. 11, they are actually present, in order to ensure the normal functioning of the work machine.

By using, as a release control valve, the normally-open control valve 28*a* driven by the pilot pressure Po that depends on the rotational power of the engine 24, automatic release of the pressure-accumulation fluid can be realized at the time of rotation abnormality of the engine 24 even if the rotational state determining section 31 is omitted as in the present embodiment.

(Modifications)

The above-mentioned embodiments can be combined as appropriate. For example, similar to the second embodiment, it may be configured to determine the rotational state of the engine 24 based on a signal from the pressure sensor 55 in the third embodiment or fourth embodiment. In addition, a configuration in which the tank valve 62 is added like the third embodiment is possible in the fourth embodiment or fifth embodiment.

In addition, for example, although a configuration in which the bottom side of the boom cylinder 17 is connected to the swing body 2 and its rod side is connected to the boom 11 is exemplified, in a configuration, the bottom side of the boom cylinder may be connected to the swing body, and its rod side may be connected to the boom. Since, in this case also, the return hydraulic fluid is pushed out from the bottom side when the work implement moves down, that is, when the boom cylinder contracts, the circuit configuration does not change. In addition, although a configuration in which the engine 24 (internal combustion engine) is used as a prime mover to drive the hydraulic pump 21 or the like is exemplified, the present invention can be applied to a work machine employing an electric motor as a prime mover.

DESCRIPTION OF REFERENCE CHARACTERS

3: Work implement
17: Boom cylinder (hydraulic cylinder)
18: Arm cylinder (hydraulic cylinder)
19: Bucket cylinder (hydraulic cylinder)
20: Hydraulic cylinder
21: Hydraulic pump
21*a*: Delivery line
22: Control valve
23: Pilot pump
24: Engine (prime mover)
25: Operation device
26: Accumulator
27: Pressure-accumulation control valve
28: Release control valve
28*a*: Release control valve
30: Hydraulic system controller (controller)
31: Rotational state determining section
32: Pressure-accumulation fluid control section
35: Engine switch (prime mover switch)
36: Revolution speed sensor
38: Engine controller (prime mover controller)
41: Bypass line
51 to 55: Pressure sensor
61: Tank line
62: Tank valve
N: Engine revolution speed
Ns: Set value
P1, P2: Operation signal
Po: Pilot pressure
Se: Activation command signal

The invention claimed is:

1. A work machine, comprising:

a work machine main body;

a work implement attached to the work machine main body;

a hydraulic cylinder configured to drive the work implement;

a hydraulic pump configured to deliver a hydraulic fluid to drive the hydraulic cylinder;

a control valve configured to control a flow of the hydraulic fluid from the hydraulic pump to the hydraulic cylinder;

a delivery line configured to connect the hydraulic pump and the control valve;

a pilot pump configured to output a pilot pressure to drive the control valve;

a prime mover configured to drive the hydraulic pump and the pilot pump;

an operation device configured to generate an operation signal to reduce the pilot pressure output from the pilot pump according to an operation to drive the control valve; and an accumulator configured to accumulate a return hydraulic fluid from the hydraulic cylinder, wherein the control valve switches a connection destination of the delivery line of the hydraulic pump, connects to at least one of a bottom fluid chamber of the hydraulic cylinder, a rod fluid chamber of the hydraulic cylinder and a tank, and connects the delivery line to the tank when the control valve takes a neutral position;

the work machine comprising:

a bypass line configured to connect the bottom fluid chamber of the hydraulic cylinder and the delivery line of the hydraulic pump by bypassing the control valve and be provided with the accumulator thereon;

a pressure-accumulation control valve configured to be provided in the bypass line and between the bottom fluid chamber of the hydraulic cylinder and the accumulator;

a release control valve provided in the bypass line and between the accumulator and the delivery line of the hydraulic pump; and a controller configured to perform control of opening the release control valve when a revolution speed of the prime mover becomes lower than a set value, wherein the hydraulic fluid released from the accumulator is discharged from discharge delivery line to the tank through the control valve when the revolution speed of the prime mover becomes lower than the set value.

2. The work machine according to claim 1, wherein the controller has:

a rotational state determining section configured to determine whether or not the revolution speed of the prime mover is lower than the set value; and a pressure-accumulation fluid control section configured to output a command signal for opening the release control valve when the revolution speed of the prime mover is determined as being lower than the set value based on a result of the determination by the rotational state determining section.

3. The work machine according to claim 2, further comprising:

a revolution speed sensor configured to sense the revolution speed of the prime mover or a pressure sensor configured to sense the pilot pressure output by the pilot pump, wherein the rotational state determining section determines whether or not the revolution speed of the prime mover is lower than the set value based on a signal from the revolution speed sensor or the pressure sensor.

4. The work machine according to claim 2, further comprising:

a revolution speed sensor configured to sense the revolution speed of the prime mover; and a prime mover controller configured to control the prime mover, and output a determination signal that a rotational state of the prime mover is unfavorable when the revolution speed detected by the revolution speed sensor is lower than a threshold value, wherein the rotational state determining section outputs an identification signal identifying the revolution speed of the prime mover being lower than the set value when the determination signal that the rotational state of the prime mover is unfavorable is input from the prime mover controller.

5. The work machine according to claim 2, further comprising:

a revolution speed sensor configured to sense the revolution speed of the prime mover; and a prime mover switch configured to issue a command for activation of the prime mover, wherein the rotational state determining section outputs an identification signal identifying the revolution speed of the prime mover being lower than the set value when the rotational state determining section receives an input of an activation command signal from the prime mover switch and the revolution speed of the prime mover sensed at the revolution speed sensor is lower than the set value.

6. The work machine according to claim 2, further comprising:

a tank line configured to branch off in the bypass line and between the pressure-accumulation control valve and the release control valve, bypass the control valve and be connected to the tank; and a tank valve configured to open and close the tank line, wherein the pressure-accumulation fluid control section opens the tank valve together with the release control valve when it is identified that the revolution speed of the prime mover is lower than the set value.

7. The work machine according to claim 2, wherein the release control valve is an electromagnetically-driven, normally-open control valve configured to be excited and closed according to a command signal from the pressure-accumulation fluid control section.

8. The work machine according to claim 1, wherein the release control valve is a hydraulically-driven, normally-open control valve configured to be closed when the pilot pressure output by the pilot pump is input.

* * * * *